US009671192B2

(12) United States Patent
Cheng

(10) Patent No.: US 9,671,192 B2
(45) Date of Patent: Jun. 6, 2017

(54) POSITIONING CONTROL MECHANISM OF EXPANDABLE BATON

(71) Applicant: KANTAS PRODUCTS CO., LTD., Taipei (TW)

(72) Inventor: Yang-Fu Cheng, Taipei (TW)

(73) Assignee: KANTAS PRODUCTS CO., LTD., Taipei (TW)

( * ) Notice: Subject to any disclaimer, the term of this patent is extended or adjusted under 35 U.S.C. 154(b) by 337 days.

(21) Appl. No.: 14/607,341

(22) Filed: Jan. 28, 2015

(65) Prior Publication Data

US 2016/0169616 A1 Jun. 16, 2016

(30) Foreign Application Priority Data

Dec. 16, 2014 (TW) ..... 103143824 A

(51) Int. Cl.
*F41B 15/00* (2006.01)
*F41B 15/02* (2006.01)

(52) U.S. Cl.
CPC ..... *F41B 15/00* (2013.01); *F41B 15/027* (2013.01); *F41B 15/02* (2013.01); *F41B 15/022* (2013.01); *F41B 15/025* (2013.01)

(58) Field of Classification Search
CPC ..... F41B 15/00; F41B 15/02; F41B 15/022; F41B 15/025; F41B 15/027
USPC ..... 463/47.7
See application file for complete search history.

(56) References Cited

U.S. PATENT DOCUMENTS

| | | | | |
|---|---|---|---|---|
| 7,488,255 | B2 * | 2/2009 | Labes | F41B 15/027 135/75 |
| D627,852 | S * | 11/2010 | Yang-Fu | D22/117 |
| D630,292 | S * | 1/2011 | Yang-Fu | D22/117 |
| 8,568,242 | B2 * | 10/2013 | Milligan | F41B 15/025 463/47.7 |
| 8,721,459 | B2 * | 5/2014 | Pelkey | F41B 15/027 463/47.7 |
| 8,956,235 | B2 * | 2/2015 | Cheng | F41B 15/027 463/47.2 |
| 2002/0187838 | A1 * | 12/2002 | Cheng | F41B 15/027 463/47.6 |
| 2005/0083679 | A1 * | 4/2005 | Macierowski | F41B 15/027 362/102 |
| 2014/0256452 | A1 * | 9/2014 | Cheng | F41B 15/027 463/47.7 |

(Continued)

*Primary Examiner* — William H McCulloch, Jr.
(74) *Attorney, Agent, or Firm* — Bacon & Thomas, PLLC

(57) ABSTRACT

The present invention is to provide a positioning control mechanism applied to an expandable baton including a first pipe provided with a clamping groove portion on two opposite inner walls thereof and a second pipe inserted into the first pipe and provided with shifting holes on two opposite wall surfaces thereof. The positioning control mechanism includes an activating mechanism and a releasing rod. The activating mechanism is formed by two activating blocks movably positioned in the shifting holes and hooked with each other to form a releasing hole therebetween. The releasing rod is mounted inside the first pipe and, when one end of the releasing rod is inserted into the releasing hole, the outer edges of the activating block can be retracted inwardly and is not inserted in the clamping groove portion, so the second pipe can be retracted into the first pipe and positioned to form a short-rod shape.

13 Claims, 10 Drawing Sheets

(56) References Cited

U.S. PATENT DOCUMENTS

| | | | | |
|---|---|---|---|---|
| 2014/0256453 | A1* | 9/2014 | Pelkey | F41B 15/027 463/47.7 |
| 2014/0334131 | A1* | 11/2014 | Bushee | F21V 33/0076 362/102 |
| 2015/0038240 | A1* | 2/2015 | Parsons | F41B 15/027 463/47.7 |
| 2016/0169616 | A1* | 6/2016 | Cheng | F41B 15/027 463/47.7 |
| 2016/0298939 | A1* | 10/2016 | Kuo | F41H 9/10 |

* cited by examiner

POSITIONING CONTROL MECHANISM OF EXPANDABLE BATON

FIELD OF THE INVENTION

The present disclosure generally relates to a positioning control mechanism, more particularly to a positioning control mechanism specifically designed for an expandable baton.

BACKGROUND OF THE INVENTION

An expandable baton can be quickly expanded to be a long-rod shape for deterring and suppressing illegal invasion and can also be quickly retracted to be a short-rod shape for facilitating the carrying during duty. Currently, when security service personnel, army and police personnel, or other security personnel operate duties, they usually carry the expandable batons to efficiently prevent from illegal penetration and further ensure the security of householders, property and personnel. In addition, the expandable baton has advantages of easy carrying and operation, so many normal persons also start to carry the expandable batons as defense tools.

There are various traditional expandable batons having different structures and functions sold in market, and a structure of the latest type expandable baton 10 sold in markets is described in the section below. Please refer to FIG. 1. The expandable baton 10 has a three-section structure formed by a first pipe 11, a second pipe 12 and a third pipe 13. Generally speaking, in the expandable baton 10 at least the first pipe 11 and the second pipe 12 are in a hollow shape and the third pipe 13 is a solid rod, so as to increase attack or defense power and capability. The third pipe 13 can be retracted into the second pipe 12, and the second pipe 12 can be retracted into the first pipe 11, so that the expandable baton 10 can be retracted to form a short-rod shape for easy collection and carrying. In addition, when the user holds the first pipe 11 and swings the expandable baton 10 forcefully, the second pipe 12 and the third pipe 13 can be expanded out of the ends of the first pipe 11 and the second pipe 12 due to their weights. The first pipe 11, second pipe 12 and the third pipe 13 are fastened with each other in order and expanded to form a long-rod shape, and the user can hold the expanded baton 10 to operate duty. Next, when the user stops using the expandable baton 10, the user just needs to press a button B disposed at other end of the first pipe 11 to enable the second pipe 12 and the third pipe 13 to respectively depart from the first pipe 11 and the second pipe 12, i.e. the state of clamping with each other is released, so the second pipe 12 and the third pipe 13 are respectively retracted into the first pipe 11 and the second pipe 12, and the expandable baton 10 is restored to a short-rod shape.

Please refer to FIG. 2. The expansion and retraction of the expandable baton 10 are mainly operated by an activating mechanism 20 and a releasing mechanism 30 disposed in the expandable baton 10. In following description, the first pipe 11 and the second pipe 12 are just taken as an example to illustrate an operation scheme of the activating mechanism 20 and the releasing mechanism 30. Please refer back to FIG. 2. In the expandable baton 10, an end of the second pipe 12 (i.e. the right end shown in FIG. 2) can be entered and passed into the first pipe 11 via other end of the first pipe 11 (i.e. the left end shown in FIG. 2), and when an outer edge of the other end of the second pipe is abutted against an inner edge of the end of the first pipe 11, other portion of the second pipe 12 can be exposed out of the end of the first pipe 11. Please refer to FIG. 3. The first pipe 11 is provided with clamping groove portions 111 respectively concavely disposed on two opposite inner walls thereof near an end thereof, and the second pipe 12 is provided with shifting holes 121 respectively disposed on two opposite wall surfaces thereof near other end thereof.

Please refer to FIG. 3, FIG. 4 and FIG. 5. The activating mechanism 20 includes two activating blocks 21 which have the same structures and can be respectively passed into the shifting holes 121 corresponding thereto. Each of the activating blocks 21 is provided with a releasing hole 211, and two elastic elements 40 are disposed between the releasing holes 211. Therefore, when the activating block 21 are overlapped with each other, the activating blocks 21 can be separated from each other by the restoring force of the elastic element 40, so the outer edges of the activating blocks 21 can be exposed out of the shifting holes 121 respectively to enable portions of the releasing holes 211 corresponding to each other to be overlapped to form an overlapping hole, so as to form a clamped state. Next, when the end of the releasing rod 31 of the releasing mechanism 30 is inserted into the overlapping hole C to enable the releasing hole 211 to be fully overlapped correspondingly, as shown in FIG. 3, the activating blocks 21 are closed up by a force of the releasing rod 31 to enable the outer edges of the activating blocks 21 to be retracted inwardly into the shifting hole 121 to form a releasing state.

Please refer back to FIG. 1 through FIG. 5. In the above-mentioned latest type expandable baton 10, the releasing mechanism 30 is movably disposed in the first pipe 11, and the end of the releasing rod 31 corresponds to the overlapping hole C. The other end of the releasing rod is exposed out of the other end of the first pipe 11 to form the button B.

Therefore, when the user holds the first pipe 11 and swings the expandable baton 10 forcefully, the second pipe 12 can be exposed out of the end of the first pipe 11. When the outer edge of the other end of the second pipe 12 is abutted against the inner edge of the end of the first pipe 11, outer edges of the activating blocks 21 are expanded outwardly due to the restoring force 40 of the elastic elements 40, and respectively exposed out of the shifting hole 121 and inserted into the clamping groove portion 111 corresponding thereto. Therefore, the first pipe 11 and the second pipe 12 can be expanded and positioned to form the long-rod shape. Next, when the user stops using the expandable baton 10, the user just needs to press the button B to enable the end of the releasing rod 31 to be inserted into the overlapping hole C and enable the releasing hole 211 to overlap with each other. Therefore, the activating blocks 21 can be closed up due to the force of the releasing rod 31 to enable the outer edges of the activating blocks 21 to be retracted inwardly into the shifting holes 121 respectively, and the second pipe 12 can be released from the state of being clamped with the first pipe 11, and retracted into the first pipe 11. The expandable baton 10 is restored to the short-rod shape.

The latest type expandable baton 10 can provide the user to conveniently control the expandable baton 10 in the long-rod state or the short-rod state. However, the activating blocks 21 are just accommodated freely within the shifting holes 121, and the elastic elements 40 are also accommodated freely between the activating blocks 21, so when the user holds the first pipe 11 and swings the expandable baton 10 forcefully, the activating blocks 21 and the elastic elements 40 are easily shifted and collided with each other due to the swinging force, and it makes click sound correspondingly. Even if the swing force or the impacting force is too large, the activating blocks 21 or the elastic elements 40 may be caused to depart from their correct positions, and the activating blocks may not correctly develop the clamping function, or the expandable baton 10 may be not normally controlled in the long-rod state and the short-rod state. Therefore, how to efficiently improve the defects of the above-mentioned traditional expandable baton is an important subject of the present disclosure.

SUMMARY OF THE INVENTION

An object of the present disclosure is to provide a positioning control mechanism of an expandable baton. The positioning control mechanism is applied to the expandable baton and at least includes a first pipe and a second pipe. An end of the second pipe is inserted and passed into the first pipe via other end of the first pipe, and when an outer edge of other end of the second pipe is abutted against an inner edge of an end of the first pipe, other portion of the second pipe is exposed out of the end of the first pipe. The first pipe is provided with a clamping groove portion on two opposite inner walls thereof near the end thereof, and the second pipe is provided with shifting holes respectively concavely disposed on two opposite wall surfaces thereof near other end thereof. The positioning control mechanism further includes an activating mechanism and a releasing rod. The activating mechanism is formed by assembling two activating blocks, and each of the activating blocks can be movably positioned in the shifting hole corresponding thereto. The activating blocks are provided with hook groove portions respectively disposed thereon, and can be hooked with each other to be combined integratedly by the hook groove portions. When the outer edge of other end of the second pipe is abutted against the inner edge of the end of the first pipe, outer edges of the activating blocks are expanded outwardly due to the restoring force between the activating blocks and inserted into the clamping groove portions respectively, so that the first pipe and the second pipe can be expanded and positioned to form a long-rod shape. Moreover, the releasing rod is mounted inside the first pipe, and the end of the releasing rod corresponds to a releasing hole formed between the hook groove portions. When other end of the releasing rod is pressed, the end of the releasing rod is inserted into the releasing hole to enable the outer edge of the activating block to be retracted inwardly and not be inserted in the clamping groove portions corresponding thereto, so the second pipe can be retracted into the first pipe and positioned to form a short-rod shape.

Other objective of the present disclosure is that the activating blocks have the same structures and can be passed through the shifting holes respectively and then hooked with each other via the hook groove portions to be combined integratedly. The releasing hole is formed between the hook groove portions, and at least two elastic elements are disposed between the activating blocks. Therefore, while the activating block are integratedly hooked with each other, the activating blocks can be separated from each other by the restoring force of the elastic element, so the outer edges of the activating blocks can be exposed out of the shifting holes respectively to enable an aperture of the releasing hole smaller to form a clamped state. Next, when the end of the releasing rod is inserted into the releasing hole to force the releasing hole larger, the activating blocks are closed up by a force of the releasing rod to enable the outer edges of the activating blocks to be retracted inwardly into the shifting hole to form the releasing state.

Another objective of the present disclosure is that each of the activating blocks is a "U" or "C" shape and provided with of a tenon at an end thereof and a first track slot concavely disposed at the inner wall of the hook groove portion thereof. When the activating blocks are hooked with each other to combined integratedly by the hook groove portions, the tenon of one of the activating blocks can be inserted into the first track slot of the other activating block and movable along the first track slot of the other activating block, so that the activating block can be firmly assembled integratedly and can steadily perform actions of being closed up or being separated from each other.

Another objective of the present disclosure is that each of the activating blocks is provided with a second track slot on the outer wall thereof corresponding to the first track slot, and the second pipe is provided with positioning holes respectively disposed on two opposite pipe walls thereof near other end thereof. Positioning pillars are screwed and fastened in the positioning holes respectively, so that an end of the positioning pillar can be inserted into the second track slot corresponding thereto, and the activating blocks can be movable and firmly positioned within the shifting holes respectively.

Another objective of the present disclosure is that positioning units (such as protruded pillars or recesses) are disposed on inner walls of the hook groove portions of the activating blocks and outer walls of the activating blocks corresponding to the inner walls. While the activating blocks are hooked with each other to combined integratedly by the hook groove portions, the two ends of the elastic elements can be positioned at the positioning units of the activating blocks corresponding thereto, to respectively apply a restoring force on the activating blocks, so that the activating blocks can be steadily maintained at the state of being separated from each other.

Another objective of the present disclosure is that the positioning control mechanism further includes a fixed base which is fastened at other end of the second pipe and provided with a center hole axially disposed thereon. The releasing rod is inserted into the center hole, and the fixed base can be provided with the shifting hole and the positioning hole disposed on two opposite wall surfaces.

BRIEF DESCRIPTION OF THE DRAWINGS

The detailed structure, operating principle and effects of the present disclosure will now be described in more details hereinafter with reference to the accompanying drawings that show various embodiments of the present disclosure as follows.

DETAILED DESCRIPTION OF THE PREFERRED EMBODIMENTS

Figure 1:
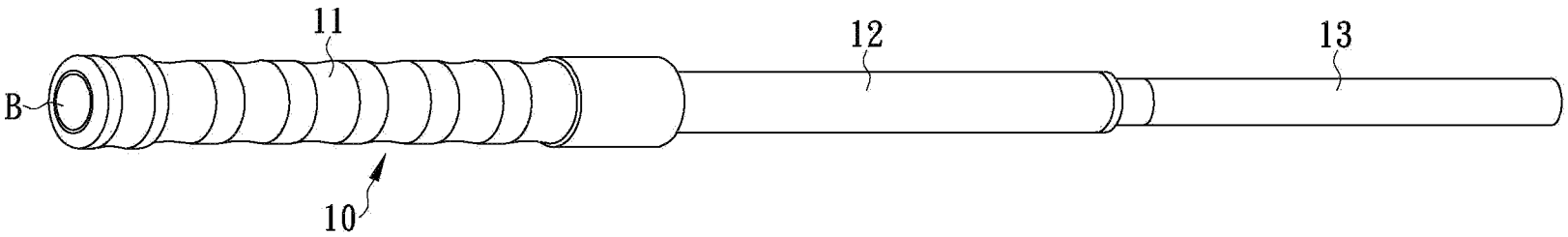
FIG. 1(Prior Art)
FIG. 1 is expansion schematic view of a traditional expandable baton.
Figure 2:
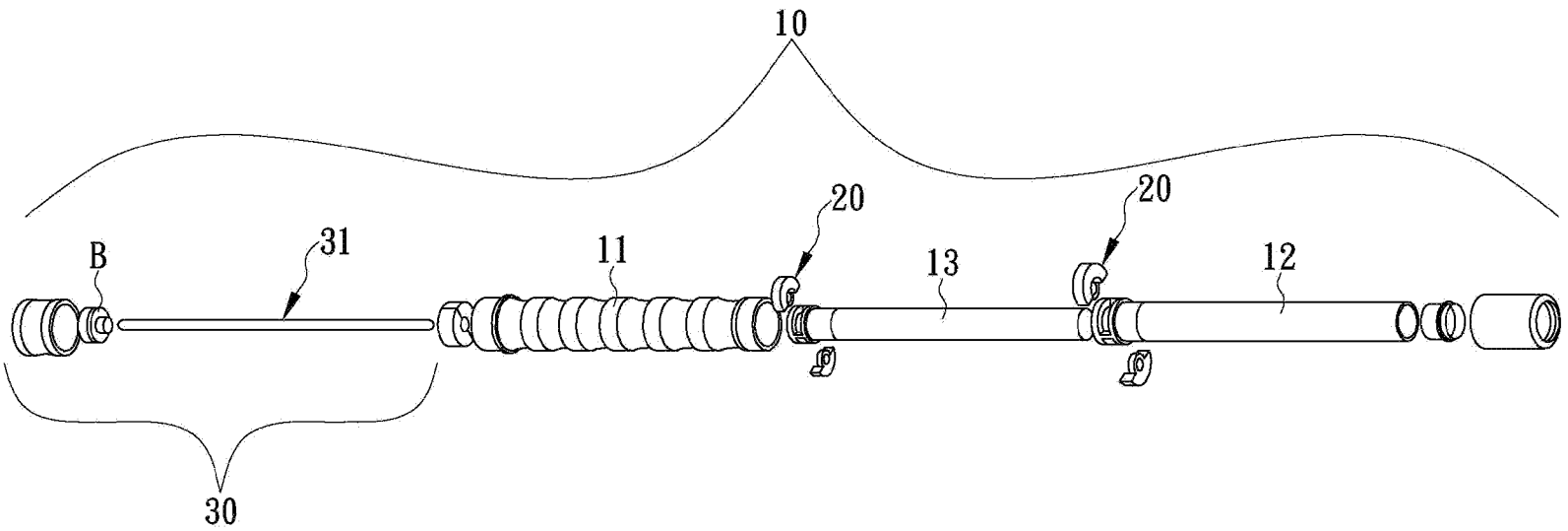
FIG. 2(Prior Art)
FIG. 2 is an exploded perspective view of the traditional expandable baton.
Figure 3:
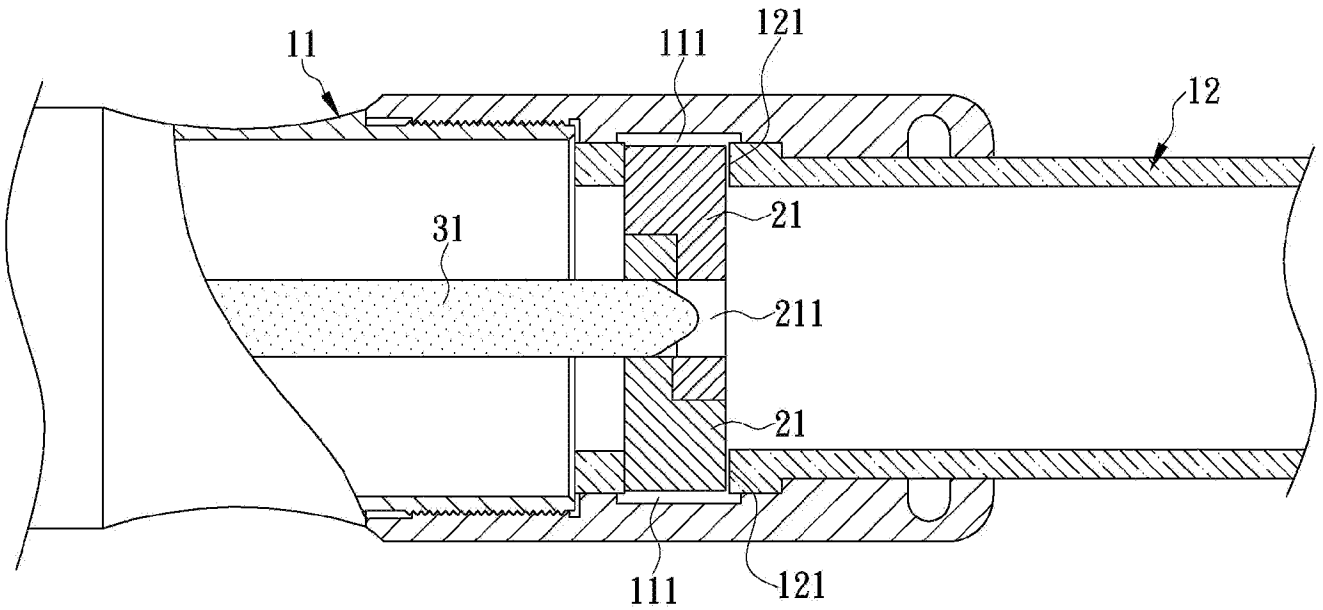
FIG. 3(Prior Art)
FIG. 3 is a partial section view of the traditional expandable baton.
Figure 4:
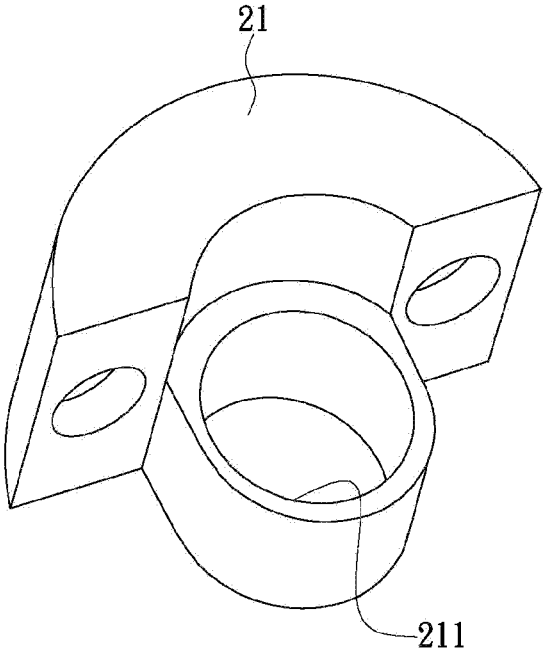
FIG. 4(Prior Art)
FIG. 4 a perspective view of an activating block of the traditional expandable baton.
Figure 5:
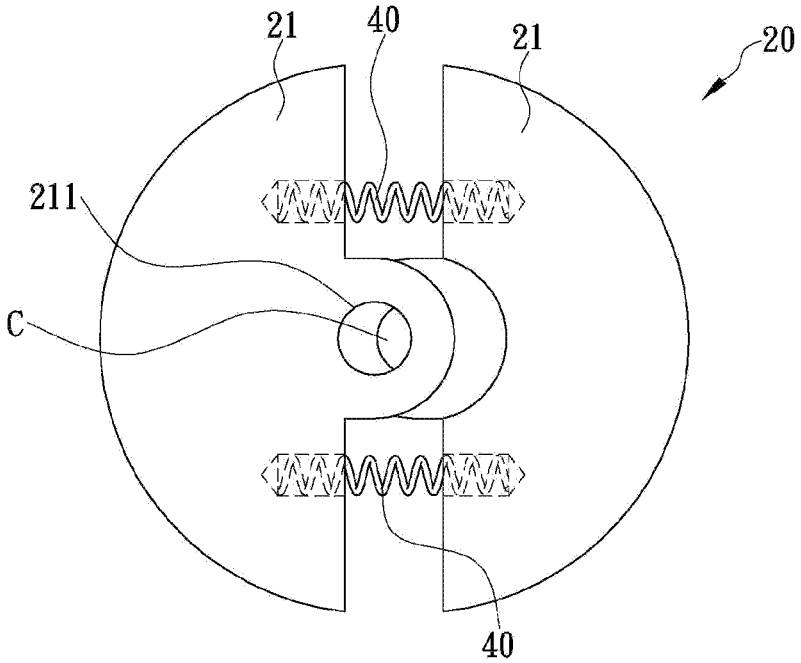
FIG. 5(Prior Art)
FIG. 5 is an assembly schematic view of the activating blocks of the traditional expandable baton.

Reference will now be made in detail to the exemplary embodiments of the present disclosure, examples of which are illustrated in the accompanying drawings. Therefore, it is to be understood that the foregoing is illustrative of exemplary embodiments and is not to be construed as limited to the specific embodiments disclosed, and that modifications to the disclosed exemplary embodiments, as well as other exemplary embodiments, are intended to be included within the scope of the appended claims. These embodiments are provided so that this disclosure will be thorough and complete, and will fully convey the inventive concept to those skilled in the art. The relative proportions and ratios of elements in the drawings may be exaggerated or diminished in size for the sake of clarity and convenience in the drawings, and such arbitrary proportions are only illustrative and not limiting in any way. The same reference numbers are used in the drawings and the description to refer to the same or like parts.

It will be understood that, although the terms 'first', 'second', 'third', etc., may be used herein to describe various elements, these elements should not be limited by these terms. The terms are used only for the purpose of distinguishing one component from another component. Thus, a first element discussed below could be termed a second element without departing from the teachings of embodiments. As used herein, the term "or" includes any and all combinations of one or more of the associated listed items.

Figure 6:
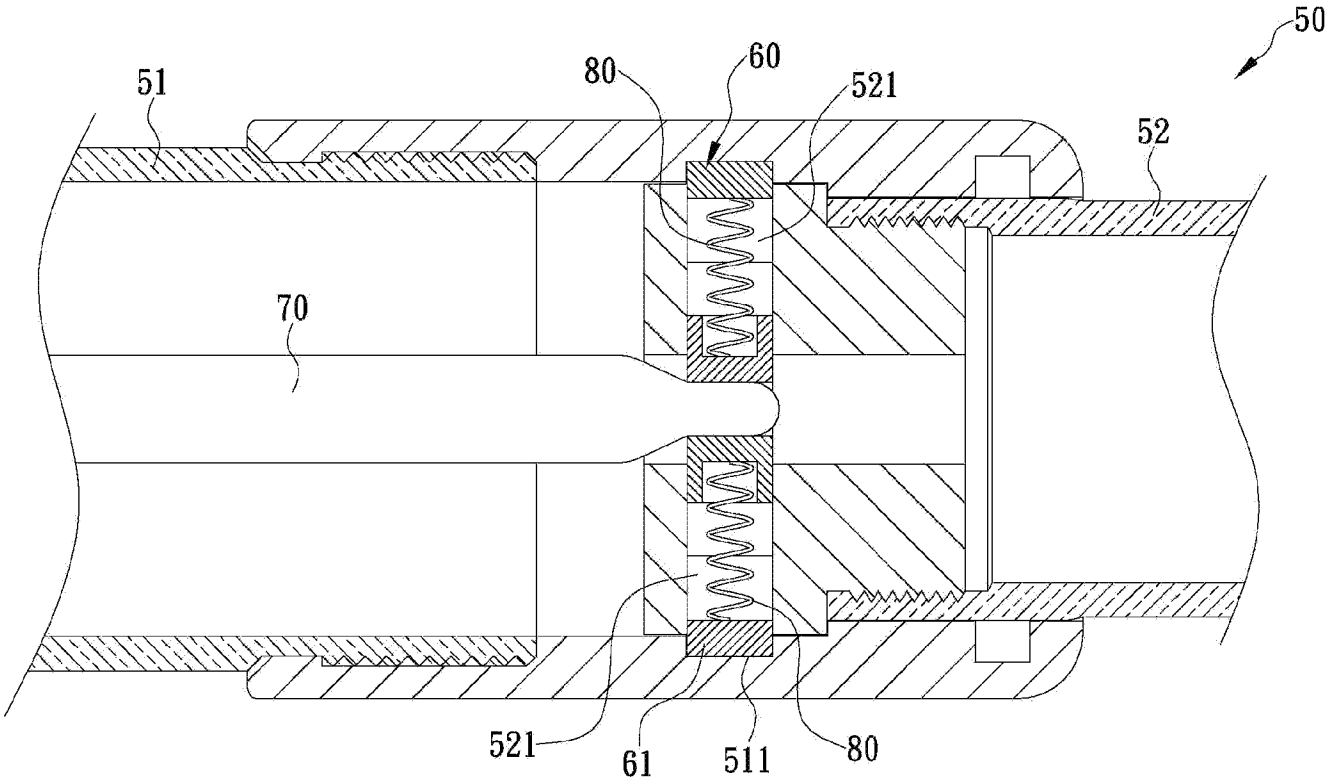
FIG. 6 is a partial section view of a clamped state of an expandable baton of the present disclosure.

The present disclosure illustrates a positioning control mechanism of an expandable baton. Please refer to FIG. 6. In a preferred embodiment of the present disclosure, the expandable baton 50 at least includes a first pipe 51 and a second pipe 52, and the first pipe 51 and the second pipe 52 can be sleeved together. An end of the second pipe 52 is entered and passed into the first pipe 51 via other end of the first pipe 51, and when outer edge of the other end of the second pipe 52 is abutted against an inner edge of an end of the first pipe 51, other portion of the second pipe 52 can be exposed out of the end of the first pipe 51, it means that the first pipe 51 is sheathed out of the second pipe 52 when the two pipes 51 and 52 are sleeved with each other. Moreover, the first pipe 51 is provided with clamping groove portions 511 respectively disposed on two opposite inner walls thereof near an end thereof, and the second pipe 52 is provided with shifting holes 521 respectively disposed on two opposite wall surfaces thereof near other end thereof. It should be particularly noted that the expandable baton 50 of the present disclosure can include two or more pipes, and the same positioning control mechanism is disposed between any two adjacent pipes. Therefore, in subsequent illustration of the present disclosure, the positioning control mechanism having only two pipes is taken as example for illustrating that how the positioning control mechanism controls the relative position and connection relationship between the first pipe 51 and the second pipe 52.

Figure 7:
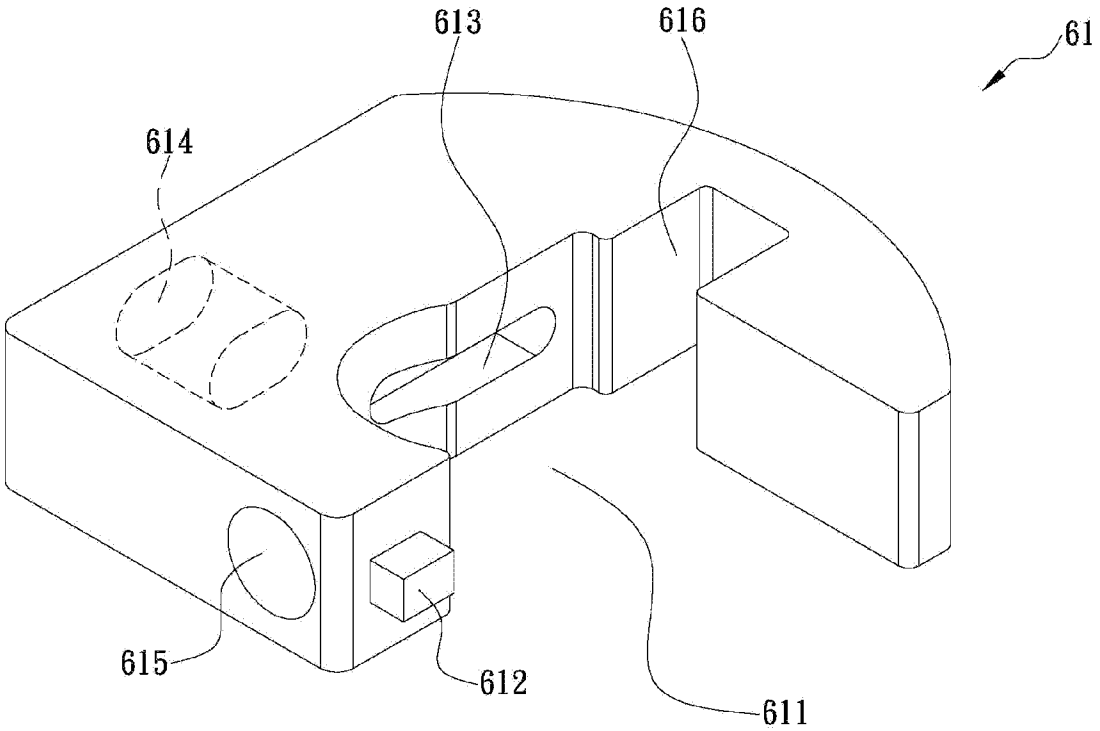
FIG. 7 is a perspective view of an activating block of the expandable baton of the present disclosure.
Figure 8:
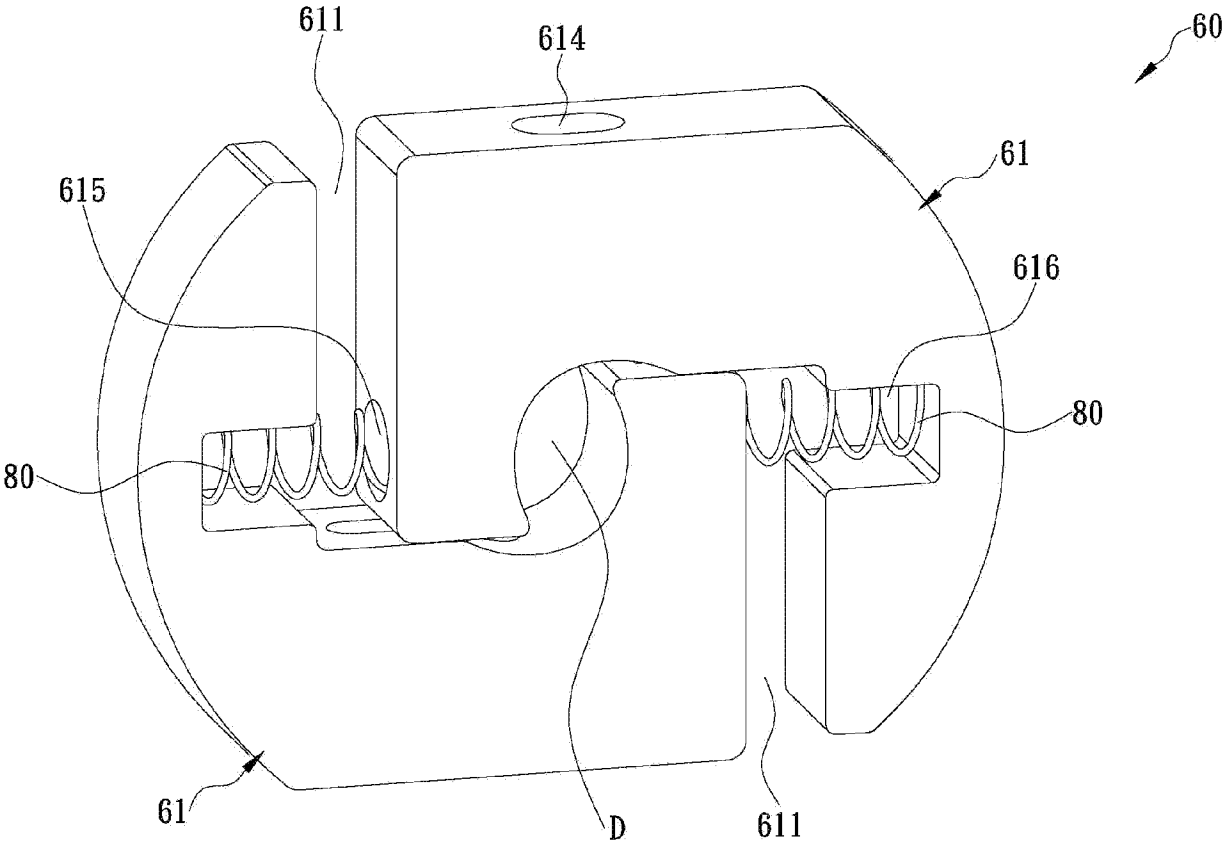
FIG. 8 is an assembly schematic view of the activating blocks of the expandable baton of the present disclosure.
Figure 9:
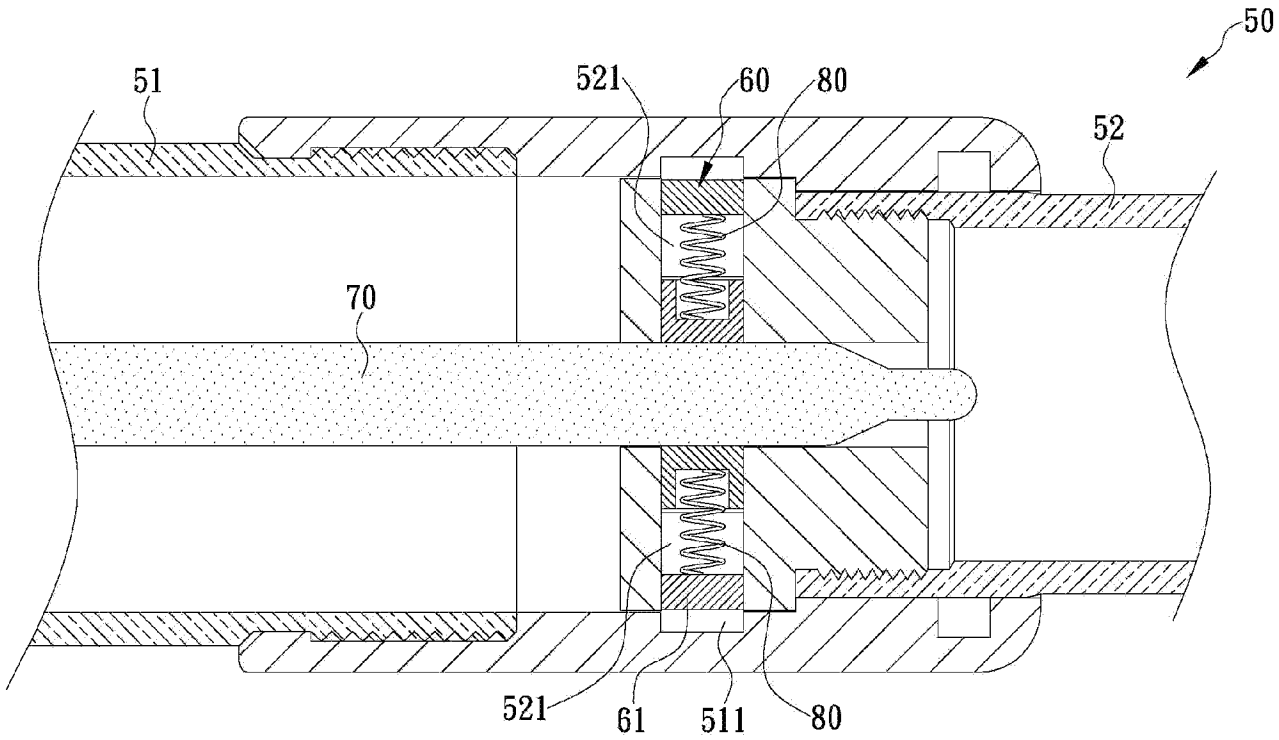
FIG. 9 is a partial section view of the expandable baton in a released state of the present disclosure.

Please refer back to FIG. 6. The positioning control mechanism includes an activating mechanism 60 and a releasing rod 70. The activating mechanism 60 is disposed on a portion of the second pipe 52 near other end of the second pipe 52, and in this embodiment the second pipe 52 is provided with the shifting holes 521 disposed at two opposite pipe walls thereof near the other end thereof. The activating mechanism 60 includes two activating blocks 61, and each activating block 61 is movably positioned in the shifting hole 521 corresponding thereto. Please refer to FIG. 7 and FIG. 8. Each activating block 61 is provided with a hook groove portion 611, and the hook groove portions 611 correspond to each other for enabling the activating blocks 61 to be hooked with each other, as shown in FIG. 8. Please refer back to FIG. 6. When the outer edge of the other end of the second pipe 52 is abutted against the inner edge of the end of the first pipe 51, outer edges of the activating blocks 61 are expanded outwardly due to the restoring force between the activating blocks 61, and be respectively exposed out of the shifting hole 521 corresponding thereto and be inserted into the clamping groove portion 511 corresponding thereto. Therefore, the first pipe 51 and the second pipe 52 can be expanded and positioned to form a long-rod shape. Please refer back to FIG. 6 and FIG. 8. The releasing rod 70 is mounted inside the first pipe 51, and an end of the releasing rod corresponds to a releasing hole D formed between the hook groove portions 611. Please refer to FIG. 9. When other end of the releasing rod 70 is pressed, the end of the releasing rod 70 is completely inserted into the releasing hole D to enable the outer edge of the activating block 61 to be retracted inwardly into the shifting hole 521 corresponding thereto, so that the outer edge of the activating block 61 is not inserted in the clamping groove portions 511 no more, and the second pipe 52 can be retracted into the first pipe 51 and be positioned to form a short-rod shape.

Please refer back to FIG. 6 and FIG. 8. The structures of the activating blocks 61 are the same with each other, and the activating blocks 61 can be passed through the shifting holes 521 respectively, and then be hooked with each other via the hook groove portions 611 to be combined integratedly. The releasing hole D is formed between the hook groove portions 611. In the preferred embodiment, at least two elastic elements 80 are disposed between the activating blocks 61. While the activating blocks 61 are integratedly hooked with each other, the activating blocks 61 can be separated from each other by the restoring force of the elastic elements 80, so that the outer edges of the activating blocks 61 can be exposed out of the shifting holes 521 respectively to enable an aperture of the releasing hole D smaller to form a clamped state shown in FIG. 6. Please refer to FIG. 9. While the end of the releasing rod 70 is completely inserted into the releasing hole D to force the releasing hole D larger, the activating blocks 61 are closed up by the force of the releasing rod 70, whereby the outer edges of the activating blocks 61 are retracted inwardly into the shifting hole 521 to form a releasing state.

Please refer back to FIG. 7 and FIG. 8. In the preferred embodiment, positioning units 615 and 616 are respectively disposed on inner walls of the hook groove portions 611 of the activating blocks 61 and outer walls of the activating blocks 61 corresponding to the inner walls. For example, the positioning unit can be a protruded pillar or a recess, and in the preferred embodiment, the positioning units 615 and 616 are recesses as shown in FIG. 8. While the activating blocks 61 are hooked with each other to combined integratedly by the hook groove portions 611, the two ends of the elastic elements 80 can be positioned at the positioning units 615 and 616 of the activating blocks 61 corresponding thereto, to respectively apply a restoring force on the activating blocks 61, so that the activating blocks 61 can be steadily maintained at the state of being separated from each other.

Please refer back to FIG. 7 and FIG. 8. In the preferred embodiment, each activating block 61 is in a "U" or "C" shape and provided with a tenon 612 at an end thereof and a first track slot 613 concavely disposed at the inner wall of the hook groove portion 611 thereof. While the activating blocks 61 are hooked with each other to be combined integratedly by the hook groove portions 611, the tenon 612 of one of the activating blocks 61 can be inserted into the first track slot 613 of the other activating block 61 and movable along the first track slot 613 of the other activating block 61. Therefore, the activating block 61 can be firmly assembled together to steadily perform actions of being closed up or being separated from each other.

Figure 10:
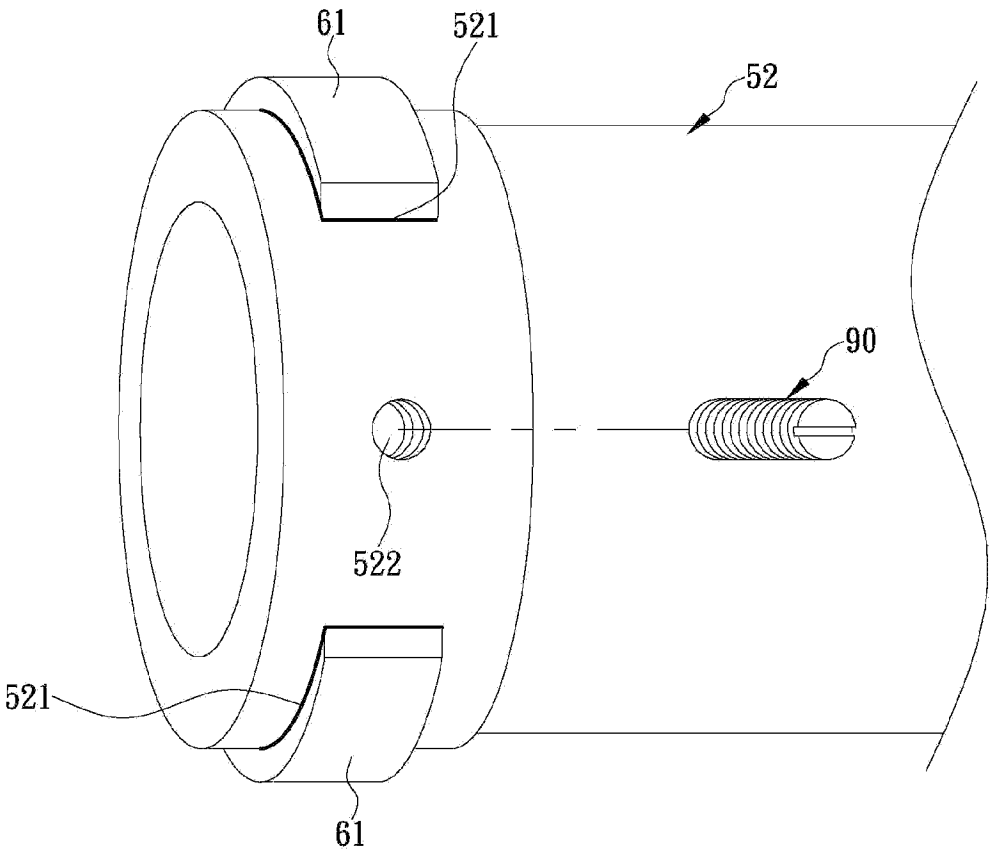
FIG. 10 is a perspective view of other end of a second pipe of the expandable baton in a preferred embodiment of the present disclosure.

Please refer back to FIG. 7 and FIG. 8. In the preferred embodiment, each of the activating blocks 61 is provided with a second track slot 614 on the outer wall thereof relative to the first track slot 613. Please refer to FIG. 10. The second pipe 52 is provided with positioning holes 522 respectively disposed on two opposite pipe walls thereof near other end thereof, and positioning pillars 90 are screwed and fastened in the positioning holes 522 respectively, so that an end of the positioning pillar 90 can be inserted into the second track slot 614 corresponding thereto, and the activating blocks 61 can be movable and firmly positioned within the shifting holes 521 respectively.

Figure 11:
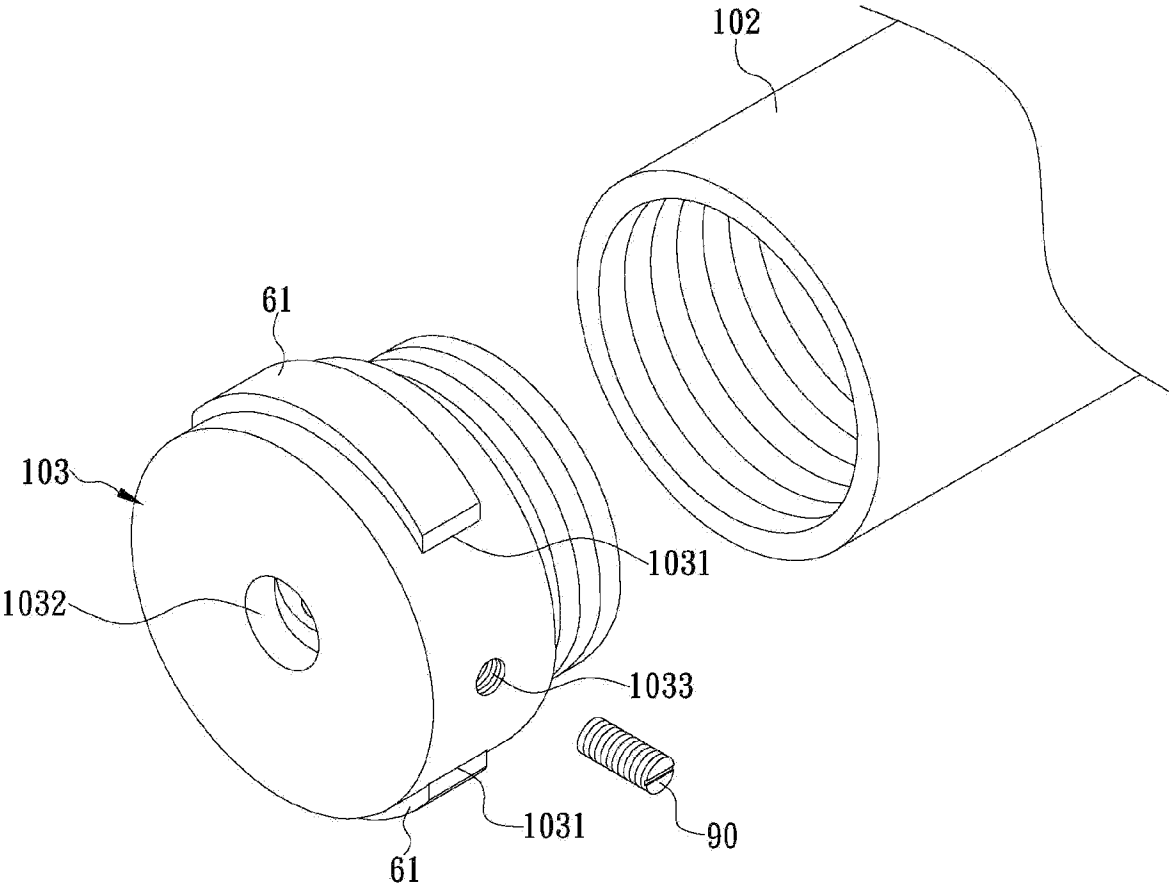
FIG. 11 is a perspective view of fixed base and other end of the second pipe of the expandable baton of other preferred embodiment of the present disclosure.

Please refer to FIG. 11. In another preferred embodiment of the present disclosure, the expandable baton is at least formed by assembly of a first pipe (not shown in FIG. 11, please refer to the first pipe 51 shown in FIG. 6), a second pipe 102 and a fixed base 103. The fixed base 103 is fastened at other end of the second pipe 102, to enable an end of the second pipe 102 to be passed inside the first pipe 51 via the other end of the first pipe 5, and when the outer edge of the fixed base 103 (or other end of the second pipe 102) is abutted against the inner edge of the end of the first pipe 51, other portion of the second pipe 102 can be exposed out of the end of the first pipe 51. The first pipe 51 is provided with clamping groove portions (not shown in FIG. 11, please refer to the clamping groove portion 511 shown in FIG. 6) respectively disposed on two opposite inner walls thereof near the end thereof, and the fixed base 103 is provided with shifting holes 1031 respectively disposed on two opposite wall surfaces thereof.

Please refer back to FIG. 11. In another preferred embodiment, the fixed base 103 is provided with a center hole 1032 axially disposed thereon, and a releasing rod (not shown in FIG. 11, please refer to the releasing rod 70 shown in FIG. 6) is passed through the center hole 1032. The activating blocks 61 are respectively movable in the shifting holes 1031 respectively disposed on two opposite wall surfaces of the fixed base 103, and the fixed base 103 is provided with positioning holes 1033 respectively disposed on other two opposite wall surfaces, so the positioning pillar 90 can be screwed and fastened in the positioning holes 1033, and an end of the positioning pillar 90 can be inserted into the second track slot (not shown in FIG. 11, please refer to the second track slot 614 shown in FIG. 7 and FIG. 8) of the activating block 61 corresponding thereto, so that the activating blocks 61 can be respectively movable and firmly positioned in the shifting holes 1031.

Therefore, after the first pipe 51 and the second pipe 52 (or 102) are expanded and positioned as the long-rod shape, and the first pipe 51 and the second pipe 52 are fastened with each other by the activating blocks 61, and the tenon 612 of one of the activating blocks 61 can be inserted into the first track slot 613 of other activating block 61, so the activating blocks 61 can be firmly assembled together by the tenons 612 and the first track slots 613. Therefore, the activating blocks 61 can be shifted along the first track slots 613 relatively to steady perform actions of being closed up or separated from each other. In addition, in the preferred embodiments of the present disclosure, the second pipe 52 is provided with a positioning hole 522 or 1033 respectively disposed on two opposite wall surfaces thereof near other end thereof, or the fixed base 103 is provided with the positioning hole 522 or 1033 on the two opposite wall surfaces thereof, to enable the positioning pillar 90 to be screwed and fastened in the positioning hole 522 or 1033, and enable an end of the positioning pillar 90 to be inserted into the second track slot 614 of the activating block 61 corresponding thereto. Therefore, the activating blocks 61 can just be shifted along the second track slots 614 within a length of the second track slots 614 (i.e. being closed up or separated from each other). Therefore, the activating blocks 61 can be movably and firmly positioned in the shifting hole 521 or 1031. Therefore, when the user holds the first pipe 51 and swings the expandable baton 50 forcefully, the activating blocks 61 and the elastic elements 80 are firmly positioned at the correct positions, so the activating blocks 61 and the elastic elements 80 are not easy to be shifted and collided between the activating blocks 61 and the elastic elements 80. Therefore, the problem of making click sound can be efficiently prevented.

In addition, the positioning control mechanism of the present disclosure has following features, so when the user applies a swinging force or an impacting force on the expandable baton 50 and the activating blocks 61 or the elastic elements 80 may be caused to depart from their correct positions, the activating blocks 61 still can be ensured to correctly develop the clamping function, whereby the expandable baton 50 can be always normally controlled in the long-rod state and the short-rod state.

First, the activating blocks 61 are hooked with each other to be combined integratedly via the hook groove portions 611, so when the user applies the swinging force or the impacting force on the expandable baton 50, the activating blocks 61 or the elastic elements 80 therein may not easily be caused to depart from their correct positions.

Secondly, when the activating blocks 61 are hooked with each other to combined integratedly by the hook groove portions 611, the tenon 612 of one of the activating blocks 61 can be inserted into the first track slot 613 of the other activating block 61 and movable along the first track slot 613 of the other activating block 61, and whereby the activating block 61 can be firmly assembled together to steadily perform actions of be closed to each other or be separated from each other. Therefore, when the expandable baton 50 is applied by too high the swinging force or the impacting force, the activating blocks 61 or the elastic elements 80 therein may not easily be caused to depart from their correct positions.

Thirdly, when the activating blocks 61 are hooked with each other to combined integratedly by the hook groove portions 611, the ends of the positioning pillars 90 are inserted into the second track slots 614 of the activating blocks 61 corresponding thereto, whereby the activating blocks 61 can just be shifted along the second track slots 614 within a length of the second track slots 614 (i.e. being closed up or separated from each other). Therefore, the activating blocks 61 can be firmly movable in the shifting hole 521 or 1031 within the lengths of the second track slots 614, and when the expandable baton 50 is applied by the swinging force or the impacting force too high, the activating blocks 61 may not easily be caused to depart from their correct positions.

The above-mentioned descriptions represent merely the exemplary embodiment of the present disclosure, without any intention to limit the scope of the present disclosure thereto. Various equivalent changes, alternations or modifications based on the claims of present disclosure are all consequently viewed as being embraced by the scope of the present disclosure.

What is claimed is:

1. A positioning control mechanism of an expandable baton, the expandable baton at least comprising a first pipe and a second pipe, an end of the second pipe inserted and passed into the first pipe via other end of the first pipe and exposed out of the end of the first pipe, the first pipe provided with a clamping groove portion on two opposite inner walls thereof near the end thereof, and the second pipe provided with shifting holes respectively disposed on two opposite wall surfaces thereof near other end thereof, and the positioning control mechanism comprising:

an activating mechanism, comprising two activating blocks which are movably positioned in the shifting holes corresponding thereto, and provided with a hook groove portion respectively disposed thereon, the activating blocks hooked to combined integratedly via the hook groove portions, wherein when the outer edge of the other end of the second pipe is abutted against the inner edge of the end of the first pipe, outer edges of the activating blocks are expanded outwardly due to the restoring force between the activating blocks, and respectively inserted into the clamping groove portions, and the first pipe and the second pipe can be expanded and positioned form a long-rod shape;

a releasing rod, mounted inside the first pipe, and an end of the releasing rod corresponding to a releasing hole formed between the hook groove portions, wherein when other end of the releasing rod is pressed, the end of the releasing rod is inserted into the releasing hole to enable the outer edge of the activating block to be retracted inwardly and not be inserted in the clamping groove portions corresponding thereto, so the second pipe can be retracted into the first pipe and positioned to form a short-rod shape.

2. The positioning control mechanism as defined in claim 1, wherein structures of the activating blocks are the same with each other.

3. The positioning control mechanism as defined in claim 2, wherein at least two elastic elements are disposed between the activating blocks, and while the activating blocks are integratedly hooked with each other, the activating blocks can be separated from each other by the restoring force of the elastic element, so the outer edges of the activating blocks can be exposed out of the shifting holes respectively to enable an aperture of the releasing hole smaller to form a clamped state, and when the end of the releasing rod is inserted into the releasing hole to force the releasing hole larger, the activating blocks are closed up by a force of the releasing rod to enable the outer edges of the activating blocks to be retracted inwardly into the shifting hole to form a releasing state.

4. The positioning control mechanism as defined in claim 3, wherein positioning units are disposed on inner walls of the hook groove portions of the activating blocks and outer walls of the activating blocks corresponding to the inner walls, and when the activating blocks are hooked with each other to be combined integratedly by the hook groove portions, the two ends of the elastic elements can be positioned at the positioning units of the activating blocks corresponding thereto, to respectively apply a restoring force on the activating blocks, whereby the activating blocks can be steadily maintained at a state of being separated from each other.

5. The positioning control mechanism as defined in claim 4, wherein each of the activating blocks is a "U" or "C" shape and provided with a tenon at an end thereof and a first track slot concavely disposed at the inner wall of the hook groove portion thereof, and when the activating blocks are hooked with each other to be combined integratedly by the hook groove portions, the tenon of one of the activating blocks can be inserted into the first track slot of the other activating block and movable along the first track slot of the other activating block, whereby the activating block can be firmly assembled together to steadily perform actions of being closed up or being separated from each other.

6. The positioning control mechanism as defined in claim 5, wherein each of the activating blocks is provided with a second track slot on the outer wall thereof corresponding to the first track slot, the second pipe is provided with positioning holes respectively disposed on two opposite pipe walls thereof near other end thereof, positioning pillars are screwed and fastened in the positioning holes respectively, whereby an end of the positioning pillar can be inserted into the second track slot corresponding thereto, and the activating blocks can be movable and firmly positioned within the shifting holes respectively.

7. A positioning control mechanism of an expandable baton, the expandable baton at least comprising a first pipe and a second pipe, an end of the second pipe inserted and passed into the first pipe via other end of the first pipe and exposed out of the end of the first pipe, the first pipe provided with a clamping groove portion on two opposite inner walls thereof near the end thereof, and the positioning control mechanism comprising:

a fixed base, fastened to other end of the second pipe, and provided with shifting holes respectively disposed on two opposite wall surfaces thereof;

an activating mechanism, comprising two activating blocks which are movably positioned in the shifting holes corresponding thereto, and provided with a hook groove portion respectively disposed thereon, the activating blocks hooked to be combined integratedly via the hook groove portions, wherein when the outer edge of the fixed base is abutted against the inner edge of the end of the first pipe, outer edges of the activating blocks are expanded outwardly due to the restoring force between the activating blocks and respectively inserted into the clamping groove portions, and the first pipe and the second pipe can be expanded and positioned to form a long-rod shape; and a releasing rod, mounted inside the first pipe, and an end of the releasing rod corresponding to a releasing hole formed between the hook groove portions, wherein when other end of the releasing rod is pressed, the end of the releasing rod is inserted into the releasing hole to enable the outer edge of the activating block to be retracted inwardly and not be inserted in the clamping groove portions corresponding thereto, so the second pipe can be retracted into the first pipe and positioned to form a short-rod shape.

8. The positioning control mechanism as defined in claim 7, wherein structures of the activating blocks are the same with each other.

9. The positioning control mechanism as defined in claim 8, wherein at least two elastic elements are disposed between the activating blocks, and while the activating blocks are integratedly hooked with each other, the activating blocks can be separated from each other by the restoring force of the elastic element, so the outer edges of the activating blocks can be exposed out of the shifting holes respectively to enable an aperture of the releasing hole smaller to form a clamped state, when the end of the releasing rod is inserted into the releasing hole to force the releasing hole larger, the activating blocks are closed up by a force of the releasing rod to enable the outer edges of the activating blocks to be retracted inwardly into the shifting hole to form a releasing state.

10. The positioning control mechanism as defined in claim 9, wherein positioning units are disposed on inner walls of the hook groove portions of the activating blocks and the outer walls of the activating blocks corresponding to the inner walls, when the activating blocks are hooked with each other to combined integratedly by the hook groove portions, the two ends of the elastic elements can be positioned at the positioning units of the activating blocks corresponding thereto, to respectively apply a restoring force on the activating blocks, whereby the activating blocks can be steadily maintained at a state of being separated from each other.

11. The positioning control mechanism as defined in claim 10, wherein each of the activating blocks is a "U" or "C" shape and provided with a tenon at an end thereof and a first track slot concavely disposed at the inner wall of the hook groove portion thereof, when the activating blocks are hooked with each other to be combined integratedly by the hook groove portions, the tenon of one of the activating blocks can be inserted into the first track slot of the other activating block and movable along the first track slot of the other activating block, whereby the activating block can be firmly assembled together to steadily perform actions of being closed up or being separated from each other.

12. The positioning control mechanism as defined in claim 11, wherein each of the activating blocks is provided with a second track slot on the outer wall thereof corresponding to the first track slot, the second pipe is provided with positioning holes respectively disposed on two opposite pipe walls thereof near other end thereof, positioning pillars are screwed and fastened in the positioning holes respectively, whereby an end of the positioning pillar can be inserted into the second track slot corresponding thereto, and the activating blocks can be movable and firmly positioned within the shifting holes respectively.

13. The positioning control mechanism as defined in claim 12, wherein the fixed base provided with a center hole axially disposed thereon, an end of the releasing rod is passed into the center hole.

* * * * *